United States Patent [19]

Mäkipirtti et al.

[11] 4,431,614

[45] Feb. 14, 1984

[54] PROCESS FOR THE SEPARATION OF GOLD AND SILVER FROM COMPLEX SULFIDE ORES AND CONCENTRATES

[75] Inventors: Simo A. I. Mäkipirtti, Nakkila; Veikko M. Polvi, Pori; Kaarlo M. J. Saari, Vanha-Ulvila; Pekka T. Setälä, Nakkila, all of Finland

[73] Assignee: Outokumpu Oy, Helsinki, Finland

[21] Appl. No.: 286,036

[22] Filed: Jul. 22, 1981

[30] Foreign Application Priority Data

Aug. 6, 1980 [FI] Finland ..... 802471

[51] Int. Cl.[3] ..... C01G 5/00; C01G 7/00

[52] U.S. Cl. ..... 423/29; 423/48; 423/88; 423/508; 75/1 R; 75/105; 75/118 R

[58] Field of Search ..... 423/29, 48, 88, 508; 75/1 R, 105, 118 R

[56] References Cited

U.S. PATENT DOCUMENTS

| | | | |
|---|---|---|---|
| 486,330 | 11/1892 | Flury | 423/88 |
| 2,187,750 | 1/1940 | Marvin | 423/29 |
| 2,238,194 | 4/1941 | Tainton | 423/88 |
| 2,454,336 | 11/1948 | Norwood | 423/29 |
| 3,174,848 | 3/1965 | Bruce | 423/29 |
| 3,220,796 | 11/1965 | Espinosa | 423/88 |
| 4,083,924 | 4/1978 | Styring | 423/88 |

FOREIGN PATENT DOCUMENTS 1057510 7/1979 Canada .

*Primary Examiner*—Helen M. McCarthy
*Assistant Examiner*—Robert L. Stoll
*Attorney, Agent, or Firm*—Brooks, Haidt, Haffner & Delahunty

[57] ABSTRACT

The present invention relates to a process for the separation of gold and silver from complex sulfide ores and concentrates which, in addition to the primary metals, contain constituents having an adverse effect on the separation of the noble metals, by heating the sulfide ore or concentrate at a temperature of 600°-900° C. and a sulfur pressure of 0.2-1 atm in order to bring the complex metal compounds to a suitable form for subsequent alkalic cyanide leaching, and by separating the gold- and silver-bearing cyanide solution from the undissolved residue.

1 Claim, 4 Drawing Figures

Symbols: mo =CoAs, sa=$CoAs_2$, co =CoAsS, cop=$Co_9S_8$, cs=$CoS_x$, li=$Co_3S_4$, ca=$CoS_2$
nsb =NiSbS, ul =NiSbS, ns=$NiS_x$, va=$NiS_2$
lö=$FeAs_2$, apy=FeAsS, po=$FeS_x$, py=$FeS_2$
ccp=$CuFeS_2$, bn=$Cu_5FeS_4$, ten =$Cu_{12}As_4S_{13}$, tet=$Cu_{12}Sb_4S_{13}$, en=$Cu_3AsS_4$, fa=$Cu_3SbS_4$
aup=$As_2S_3$, stb=$Sb_2S_3$,

PROCESS FOR THE SEPARATION OF GOLD AND SILVER FROM COMPLEX SULFIDE ORES AND CONCENTRATES

BACKGROUND OF THE INVENTION

The process according to the invention thus relates to a process for enhanced separation of gold and silver from complex concentrated sulfide ores and concentrates. In addition to the primary metals, iron, cobalt, nickel and copper (zinc, lead), these complex ores contain the following constituents: arsenic, antimony, bismuth, selenium and tellurium.

Arsenic, antimony, bismuth, selenium and tellurium, both as such and together with sulfur, combined with the primary and/or noble metals, have a very adverse effect on the separation of gold and silver during the alkalic cyanide leaching of the ore or concentrate in the presence of oxygen. This adverse effect is due both to the solubility, in alkalic cyanide solutions, of the minerals which contain them, and also to their ability to form, on the surface of gold (silver), covering layers which prevent or inhibit cyanidation. When conventional processes are used, the concentrate or ore is roasted in order to eliminate the detrimental constituents and their compounds. However, often the roasting does not eliminate the covering-layer problems, and furthermore, it produces dense oxides which keep the noble metals enclosed, and soluble compounds which consume cyanides. The fly dusts which contain arsenic, antimony and bismuth are difficult to separate from the gas phase, highly toxic, and hazardous to the environment.

In the main, the processes for the treatment of low-grade gold and silver ores have remained unchanged for several decades.

The largest and richest low-grade gold ore deposits are found in South Africa. This discussion is primarily based on the data obtained from the refining of these ores [R. J. Adamson; Gold Metallurgy in South Africa, Johannesburg, 1972; P. J. D. Lloyd; Min. Sci. Engng. 10, 1978, 208–221]. The general features of Australian gold metallurgy are also discussed [K. J. Henley; Min. Sci. Engng. 7, 1975, 289–312, P. E. Clarke, N. Jackson, J. T. Woodcock; Australasian Inst. Min. Met. Proc. 191, 1959, 49–92]. Two principal categories can be distinguished in the South African gold ores, i.e. the Witwatersrand and the Barberton Mountain Land systems. In the former system, gold is present in quartz-serisite conglomerates and to a very small extent in sulfides or sulfates. In the latter system, gold and silver are present to a small extent in quartzes but in large amounts in conjunction with about 30 native metals or arsenides, antimonides, sulfides or sulfo-salts of metals (Cu, Fe, Ni, Co, Zu, Pb).

The treatment of gold and silver ores is primarily based on the following properties of these metals:

The high density of the native metals (Au, Electrum) and their compounds (density/compound: 16–19.3/Au(Ag), 15.5/$Au_2Bi$, 9.9/$AuSb_2$, 9.1/$Ag_3AuTe$).

The low surface tension between gold and mercury (Hg wets gold and thereby binds it physically).

The solubility of gold, silver, their selenides and tellurides, and sulfides, in alkalic cyanide solutions under oxidizing conditions.

The conventional processing of gold/silver ores includes the following stages:

1. Ore crushing and grinding

2. Concentration based on the specific gravity of noble metals
3. Amalgamation of the concentrate obtained from stage 2
4. Froth-flotation of the residue obtained from stage 2
5. Roasting and washing of the froth-flotation concentrate from stage 4
6. Cyanidation of the calcine
7. Filtration of the cyanide solution and precipitation of the noble metals
8. Smelting of the noble metal precipitate (7) and of the distillation residue of the amalgam (3).

Certain essential process stages are discussed below. By using the separation process based on the specific gravity difference between noble metals and the gangue, it is possible to obtain in the concentrate those coarse fractions of the gold minerals and gold which, being large in size and small in surface area, retard the cyanide leach. The recovery of gold by these processes is high. Yield values of 11–19% and 28–73% are mentioned for African and Australian refining plants, respectively.

Apparatus for concentration based on the specific gravity principle are numerous; some examples: Corduroy tables and gutters, grooved-belt concentrators, vibrating tables, Jig concentrators, Johnson's cylinder, etc.

The concentrate obtained from the separation stage 2 is amalgamated. Before the adoption of the method of using cyanide, all gold was separated by amalgamation. The amalgamation plant then comprised a stamp mill, as well as amalgamated silver-surfaced copper sheets used for amalgamation. Later, amalgam sheets were also used in the Corduroy gutter and similar apparatus. Nowadays, drum systems are used which allow the use of amalgamation activators. The amalgamation process is inhibited by dissolved sulfides, frothing agents, oils, fats, gold-covering layers, etc.

About 28–73% of the total gold content of the ore is recovered by means of amalgamation (on the average, 43% in African plants)

The residue obtained from the separation stage 2 is cyanided as such, if elements or compounds harmful to leaching are not present (quartz ores: Witwatersrand System). When gold is present in the ore in a finely-divided form, it can be cyanided without using pretreatment methods (Carlin, Nev., U.S.A.). As well known, native gold and silver, their alloys and certain compounds dissolve when mixed in the presence of oxygen in alkalic cyanide solutions. The dissolving reaction as regards gold is $$2Au+4CN^-+O_2+2H_2O \rightleftharpoons 2Au(CN)_2^-+H_2O_2+2OH^-$$

With a cyanide concentration of 0.02–0.08% by weight NaCN, the time required for the leaching is 6–72 hours (Kalgoorlie: 0.06–0.15% by weight NaCN, 6–88 hours). Tellurides, silver and silver compounds dissolve slowly. The rate of dissolving of gold is strongly dependent on the degree of grinding, particle size and covering on its surface, which may increase the above-mentioned leaching periods to manyfold.

If the residue from the separation stage 2 contains a large amount of sulfur compounds, selenides, tellurides, arsenic and sulfo-salts containing antimony and bismuth, etc. [Barberton Mountain Land, Kalgoorlie], this residue is froth-floated in order to remove the gangue minerals low in valuable metals.

The concentrate obtained, which contains the sulfides and other compounds, is roasted. The roasting must be carried out very carefully and under controlled conditions. The sulfur of the concentrate must be oxidized quantitatively and in such a manner that a soluble sulfate is obtained from the copper, that alkalic ferric sulfate is not produced (cyanicide), and that iron oxidizes to hematite. Hematite produced at a low temperature is porous, and sub-microscopic or otherwise enclosed gold is thus leachable. Impervious magnetite must not form, and therefore the oxygen pressure in the system must be controlled. Above 600° C., hematite also begins to become more impervious.

The following values have been obtained as losses of gold as a fraction of the temperature when roasting thioarsenide (26.85 Fe, 15.52 As, 19.30 S, 0.20 Cu, 0.16 Sb) (loss, %/temperature, °C.): 18.8/615, 28.1/700 and 33.7/802. [J. V. N. Dorr, S. L. Boosqui: Cyanidation and Concentration of Gold and Silver Ores, New York 1950, 170].

During roasting, the covering layer formed on the noble-metal surfaces by the collector agent is removed, but soluble sulfur, iron, arsenates, bismuth (covering layer risk), thiosulfates, etc., are often left in the product. The product of roasting must be washed very carefully before cyanidation.

SUMMARY OF THE INVENTION

The object of the process according to the invention is to remove or make ineffective the elements detrimental to the treatment of gold ores, and compounds of the same, even before the actual processing. This is effected by means of structural-change sulfidization of the minerals of the ore or concentrate. The sulfidization is carried out at an elemental sulfur partial pressure of $P_{S2}=0.2-1.0$ atm and within a temperature range of $T=600°-900°$ C. During the sulfidization, the mineral lattices which contain the detrimental substances break down, and sulfidic new lattices, stable under the treatment conditions, are formed. The detrimental elements and/or their sulfides pass, either totally or in part, into the gas phase during the sulfidization.

By regulation of the sulfidization (sulfur pressure, temperature, time), a structure which is poorly soluble in alkalic cyanide solutions (e.g. pyrite, chalcopyrite) can be obtained for the sulfide lattices of the primary metals. The regulation of the sulfidization also produces the breaking down of the solid solution of gold (silver) and both the original and the new mineral lattices and the rearrangement of submicroscopic and partly also native noble metal in the large pore surfaces of the matrix (the time required for the dissolving of the gold is decreased).

Sulfidization causes a very strong decrease in the particle size of the ore or concentrate, pore formation, and an increase in the free surface and the particle interface area in the particle matrix. Thus it is very easy to oxidize (chlorinate, etc.) the surface of the sulfidized concentrate when necessary, at a low temperature, for example, which may be advantageous for removing the covering layer of the noble metal or for making the sulfide inert as regards solubility. As the physical state of the concentrate changes under the effect of sulfidization, the coarse-grained gold (+silver) originally in the form of an intrusion or an agglomerate detaches and can, when desired, be separated by a concentration process based on the specific gravity difference before the cyanidation. The noble metal concentrate thereby obtained can be treated, when so desired, separate from the actual main part of the product of sulfidization.

When the process according to the invention is applied to the refining of complex sulfidic gold ores, the roasting and sulfuric acid processes used in conventional methods can be eliminated. Depending on the grade of the gold ore, the amalgamation and concentration based on the specific gravity can also be eliminated in many cases. Simple, controlled structural-change sulfidization of the ore or concentrate can be used instead; it is very advantageous both technically and economically in the separation process of noble metals and, furthermore, non-polluting and non-hazardous to the environment.

Description of ores and concentrates included within the scope of the process according to the invention The ores which contain pure noble metals or their compounds and are within the scope of the process, are discussed and listed below. In mineral groups primarily containing sulfides, gold and silver are mainly associated with the mineral groups of the pyrite-marcasite families. On the basis of the composition and the sulfur content, the following groups can be distinguished:

$(Fe,Co,Ni)(S,Se)_2$
$(Au,Pt)(As,Sb)_2$
$(Fe,Co,Ni)(As,Sb)S$
$(Fe,Co,Ni)As_2$

Close to the above-mentioned compositions are the minerals of the skutterude series: $(CoNi)As_3$, $(Co,Ni,Fe)As_{2.9}$. The following of the mineral groups (with their type compositions) which contain gold, silver and silver minerals can be mentioned:

Copper pyrite series, $Cu(Fe,Ga,In)S_2$
Tin pyrite series, $Cu_3(As,Sb,Fe,Ge)S_4$
Enargite series, $Cu_3(As,Sb)S_4$
Fahlerz series, $(Cu,Ag)_{12}(Cu,Ag,Fe,Ge,Hg,Sn)_{1.2}(As,Sb,Bi)_8S_{26}$
Cubanite series, $(Cu,Ag)Fe_2S_3$ In addition to those mentioned above, important gold- and silver-bearing mineral series include the lead glance series, the red nickel pyrite series, and the antimonite series. As regards silver minerals, one of the most important mineral groups is the very extensive group of As-Sb-Bi complex minerals, of which some examples are Red glance series, $Ag_3(As,Sb)S_3$
Stephanite group, $Ag_5SbS_4$, $Ag_3Bi(S,Te)_3$, $AgBi_3S_5$
Andonite group, $Pb_2Ag_2Sb_6S_{12}$ Gold seldom forms separate minerals, and even those usually appear in association with the above-mentioned mineral groups. Some examples of gold minerals are: $AuTe_2$, $Au_4AgTe_{10}$, $AuAgTe_4$, $AuTe_3$, $Ag_3AuTe_2$, $Ag_2Te$, $Au(Pb,Sb,Fe)_8(S,Te)_{11}$, $CuAuTe_4$, $AuSb_2$, $Au_2Bi$, $Ag_3AuS_3$, $Au_2S$, $Au_2S_3$.

The mechanism of the cyanidation process of gold and silver The dissolving of gold and silver in cyanide solution is a corrosion process, in which in the anodic area there occurs formation of an auro- and argentocyanide complex, i.e. (written as regards gold)

$$2Au \rightarrow 2Au^+ + 2e$$

$$2Au^+ + 4CN^- \rightarrow 2Au(CN)_2^- + 2e$$

and within the cathodic area there occurs reduction of oxygen, i.e.

$$O_2+2H_2O+2e \rightarrow H_2O_2+2OH^-$$

The gross reaction is thus $$2Au+4CN^-+O_2+2H_2O \rightarrow 2Au(CN)_2^-+H_2O_2+2OH^-$$

The mixing conditions being constant, the reaction rate in the cyanidation reaction is determined by the diffusion of cyanide. When the diffusion of cyanide exceeds the diffusion of oxygen, the latter begins to determine the rate.

Increased mixing increases the reaction rate but does not change the limit value ratio $[CN]/[O_2]$, in which the cyanide diffusion control of the rate changes to oxygen diffusion control. It has been shown experimentally that the $[CN]/[O_2]$ ratio being below the critical value, the reaction rate is proportional to the cyanide concentration (and independent of the oxygen concentration). The ratio being above the critical value, the rate is proportional to the oxygen concentration.

The critical $[CN]/[O_2]$ ratio can be calculated using the diffusion values, and it is within a range of 6–8. At room temperature, 8.2 mg $O_2$ dissolves in one liter of water, i.e. concentration $0.256\times10^{-3}$ mol/l. The critical ratio is thus within the range $(6\text{–}8)\times0.256\times10^{-3}$ mol/l, i.e., for KCN the concentration is [KCB]=0.010–0.013% by weight.

The rate of cyanidation is only slightly dependent on the temperature, the activation energy being within a range of 2000–5000 cal/mol.

Under optimum oxidation and mixing conditions, the maximal dissolving rate of gold is $r=3.25$ mg $cm^{-2}h^{-1}$. Thus a lump of gold of 150 μm dissolves in 44 hours. The dissolving rate of pure silver is about one-half of that of gold.

The effect of technical solutions on cyanidation Technical solutions have very complicated structures, and this can be expected to have a strong effect on the sensitive cyanidation process. The ions of most technical solutions affect the rate of cyanidation by either decelerating or accelerating it. Ions which behave neutrally as regards the rate include $Na^{+1}$, $K^{+1}$, $Cl^{-1}$, $NO_3^{-1}$, $SO_4^{-2}$.

Pb, Hg, Bi and Te ions accelerate the rate of cyanidation. These ions are assumed to precipitate out from the solution onto the gold surface and change its surface properties (alloying). This, for its part, may cause thinning of the film which covers the surface, whereby the diffusion distances between the cyanide ion and oxygen and the reaction surface are decreased and the rate increases. The ratio of cyanidation may decrease for the following reasons, for example: the concentration of available oxygen or cyanide in the solution decreases owing to secondary reactions; a covering layer is formed on the metal surface and prevents the action of the cyanide or oxygen ions on the metal.

The spending of the available oxygen in solutions is due to, for example, the reactions of the ions $Fe^{+2}$ and $S^{-2}$, which produce ferrous and ferric hydroxide, thiosulfate, etc.

The available cyanide in the solutions may be lost primarily owing to the formation of complex cyanides of the ions $Fe^{+2}$, $Zn^{+2}$, $Cu^{+2}$, $Ni^{+2}$, $Mn^{+2}$, etc., or also when thiocyanates are formed. Ferric and aluminum hydroxides may also decrease the cyanide concentration in solutions owing to adsorption. The formation on the gold surface of a covering layer which prevents cyanidation may be due to very different reasons, some of which are:

- in the presence of sulfide ions the covering layer may form from aurosulfide
- under oxidizing conditions the covering layer is formed from red gold oxide
- in the presence of calcium ions and the pH being high, calcium peroxide is precipitated onto the gold surface
- the concentration of $Pb^{+2}$ ions being high, the formation of an insoluble $Pb(CN)_2$ layer may prevent cyanidation
- frothing agents may cause the formation of covering layers; for example, ethyl xanthate causes the formation of an insoluble gold xanthate.

Description of the effect of natural minerals on cyanidation

The behavior of natural minerals significant in terms of the process according to the invention in an alkalic cyanide leach is discussed.

Copper minerals

The cuprous ion forms stable soluble complexes in a cyanide solution. Cuprous cyanide is insoluble, but as the concentration of cyanide increases, a soluble complex is converted in series $Cu(CN)^{-n}_{n+1}$.

In an aqueous solution, the cupric ion is converted to cuprous:

$$Cu^{+2}+2CN^- \rightleftarrows Cu(CN)_2$$

$$2Cu(CN)_2 \rightleftarrows 2CuCN+C_2N_2$$

$$CuCN+nCN^- \rightleftarrows Cu(CN)_{n+1}^{-n}$$

The cyanidation of gold is not affected if in the solution the ratio $\Sigma[CN]/\Sigma[Cu]\geqq4$. The cuprous cyanide complexes bind, however, a large amount of the cyanide of the solution (5.5 times the amount required by gold) and, on the other hand, when gold is being precipitated by means of zinc, copper coprecipitates (refining is necessary).

The solubilities of certain common copper minerals (% by weight/mineral) in a cyanide solution [$t=25^h$, T=298 K, [NaCN]=0.10% by weight, density of slurry=9%; E. S. Leaver, J. A. Woolf: U.S. Bur. Min., Techn. Paper 497, 1931] are as follows 94.5/azurite—$2CuCO_3.Cu(OH)_2$, 90.2/malachite—$CuCO_3.Cu(OH)_2$, 90.2/chalcocite—$Cu_2S$, 85.5/cuprite—$Cu_2O$, 70.0/bornite—$Cu_5FeS_4$, 65.8/enargite—$Cu_3AsS_4$, 21.9/tetrahedrite—$Cu_{12}Sb_4S_{13}$, 5.6/chalcopyrite—$CuFeS_2$. The mineral least detrimental to cyanidation is thus poorly soluble chalcopyrite.

Iron minerals

In an alkalic cyanide solution, ferrous and ferric ions form respective complex cyanides ($Fe(CN)_6^{-4/-3}$) and thereby spend the available cyanide of the solution. Readily soluble sulfates, carbonates and ferrohydroxide are especially detrimental iron minerals. Poorly soluble hematite and magnetite do not cause notable problems in cyanidation.

Sulfides of iron are common structural constituents of gold ores. Of these, pyrite and marcasite are poorly soluble in alkalic solutions. Pyrrhotite is considerably soluble, and especially its easily releasable overstoichiometric sulfur causes a very detrimental increase in the number of sulfide ions in the solution. Without discussing the unclear mechanism of the dissolving of iron sulfides, it can be stated that, as a result of the dissolving of the sulfides, ions $S^{-2}$, $SCN^{-1}$, $S_2O_3^{-2}$, $Fe^{+2/+3}$, $Fe(CN)_6^{-3/-4}$, among others, are present in the alkalic cyanide solution in addition to elemental sulfur.

The sulfide ion is a highly effective retardant of the cyanidation of gold. Contents lower than $[S^{-2}]=0.05$ ppm already lower the rate of dissolving. This is due to the strong adsorption of the ion to the surface of gold. Even if there occurred rapid combining of sulfide ion in thiosulfate or thiocyanate, the presence of sulfide ions is always a risk in the treatment of sulfidic ores. The effect of the sulfide ion can be decreased by combining it with lead or by forming, by oxidation in an alkalic solution, a ferrihydroxide precipitate on the surface of the iron sulfide to prevent it from dissolving.

Arsenic and antimony minerals

The arsenic-bearing minerals of iron, löllingite ($FeAS_2$) and arsenopyrite (FeAsS) are conventional structural constituents of gold ores. The sulfides realgar (AsS) and orpiment ($As_2S_3$) also appear as such in the ores. The arsenic- and antimony-bearing minerals enargite and tetrahedrite were already discussed in connection with copper ores. Stibnite ($Sb_2S_3$) as such or antimony combined with gold is present in many gold ores. The presence of antimony and arsenic in silver minerals is common.

Arsenopyrite is more poorly soluble in alkalic cyanide solutions than the arsenic and antimony minerals of copper. The solubility of the sulfides of arsenic and antimony (% by weight/mineral) is quite considerable ($t=6^h$, T=298 K., [NaCN]=0.05, pH=12.2: N. Hedley, H. Tabachnick: ACC, Mineral Dressing Notes, No. 23, 1958, 1-54), i.e. $73.0/As_2S_3$, $21.1/Sb_2S_3$, $9.4/As_2S_2$.

Products (some of them momentary) of reactions of orpiment in an oxidizing alkalic cyanide solution include $AsS_3^{-2}$, $AsO_3^{-2}$, $AsO_4^{-2}$, $S^{-2}$, $S_2O_3^{-2}$, $SO_4^{-2}$, $CNS^{-1}$. Cyanidation is effectively inhibited by both sulfide and thioarsensite ions, which are adsorbed onto the surface of gold. The behavior of stibnite in an alkalic cyanide solution is analogous to orpiment. The detrimental effect of sulfide, thioarsenite and thioantimonite ions can be modified by adding to the solution lead ions, which combine the sulfide ion as a sulfide and accelerate the oxidation of thio-compounds. The conventional practice in the processing of arsenic and antimony ores is an oxidizing alkalic solution treatment or roasting before cyanidation. During roasting, arsenic and antimony evaporate or are converted to an insoluble form. It should be pointed out that covering layers (Au-Bi, $Ag_3AsO_4$, $FeAsO_4$, $(AgO)n.(Sb_2S_3)m$, etc.) detrimental to cyanidation can also be easily produced during roasting.

DESCRIPTION OF THE PREFERRED EMBODIMENTS

Figure 4:
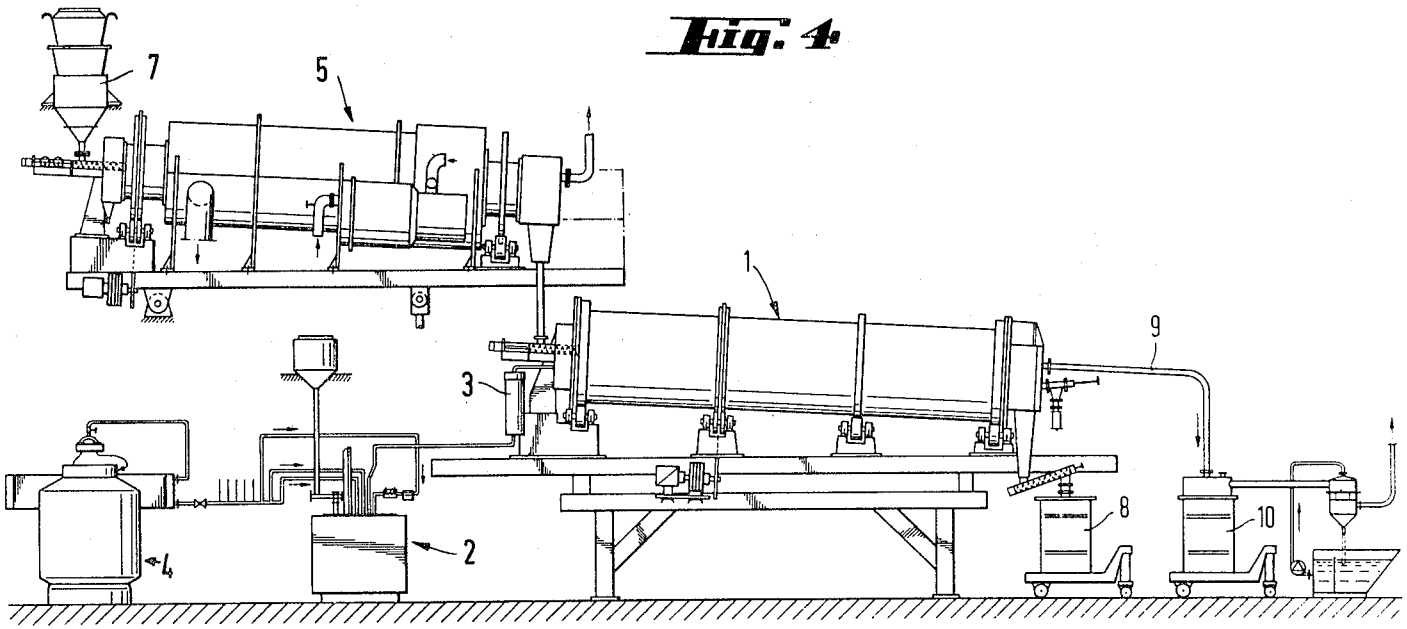
FIG. 4 depicts an apparatus suitable for carrying out the process according to the invention.

In FIG. 4, the sulfidization drum is indicated by 1, the sulfur vaporizer by 2, the device for preheating elemental sulfur by 3, the vaporizer for nitrogen which is used as carrier gas by 5, the concentrate preheating drum by 6, the feeding device of the sulfidization drum by 7, and the discharging device by 8, the carrier gas outlet pipe by 9, and the condenser by 10.

Carrier gas generated by means of $N_2$ vaporizer 5 and elemental sulfur vapor from sulfur vaporizer 2 were fed into the sulfidization drum 1 via the preheating device 3. From the sulfidization furnace 1, the sulfur vapor which contained the constituents As, Sb, Bi, Se and Te, and the carrier gas, were directed through the pipe 9 to the condenser 10, in which a sulfur polymer containing the constituents mentioned above was produced.

Structural-change sulfidization of gold and silver ores, as well known, gold and silver are often strongly associated with mineral groups of the pyrite-marcasite family. The sulfur in the minerals of the groups may totally or in part have been replaced by arsenic, antimony and bismuth (selenium and tellurium are also important as replacing elements). In order to eliminate these constituents detrimental to cyanidation and in order to convert the structure of the minerals in the ore matrix and the physical distribution of gold and silver to advantageous ones for cyanidation, structural-change sulfidization of the minerals is used in the process according to the invention.

The lattices of arsenides, antimonides or thio-compounds of the primary metals (Fe, Co, Ni) are broken down by means of the structural-change sulfidization, and lattices of pyrites and pyrrhotite of the primary metals, and pure sulfides of arsenic and antimony, are formed in their stead. The sulfides of As, Sb, Bi, Se, Te are evaporated totally or in part as they form. The structural-change sulfidization is carried out within a temperature range of 600°-900° C., in an elemental sulfur partial pressure of $P_{S2}=0.1-1.0$ atm.

Figure 1:
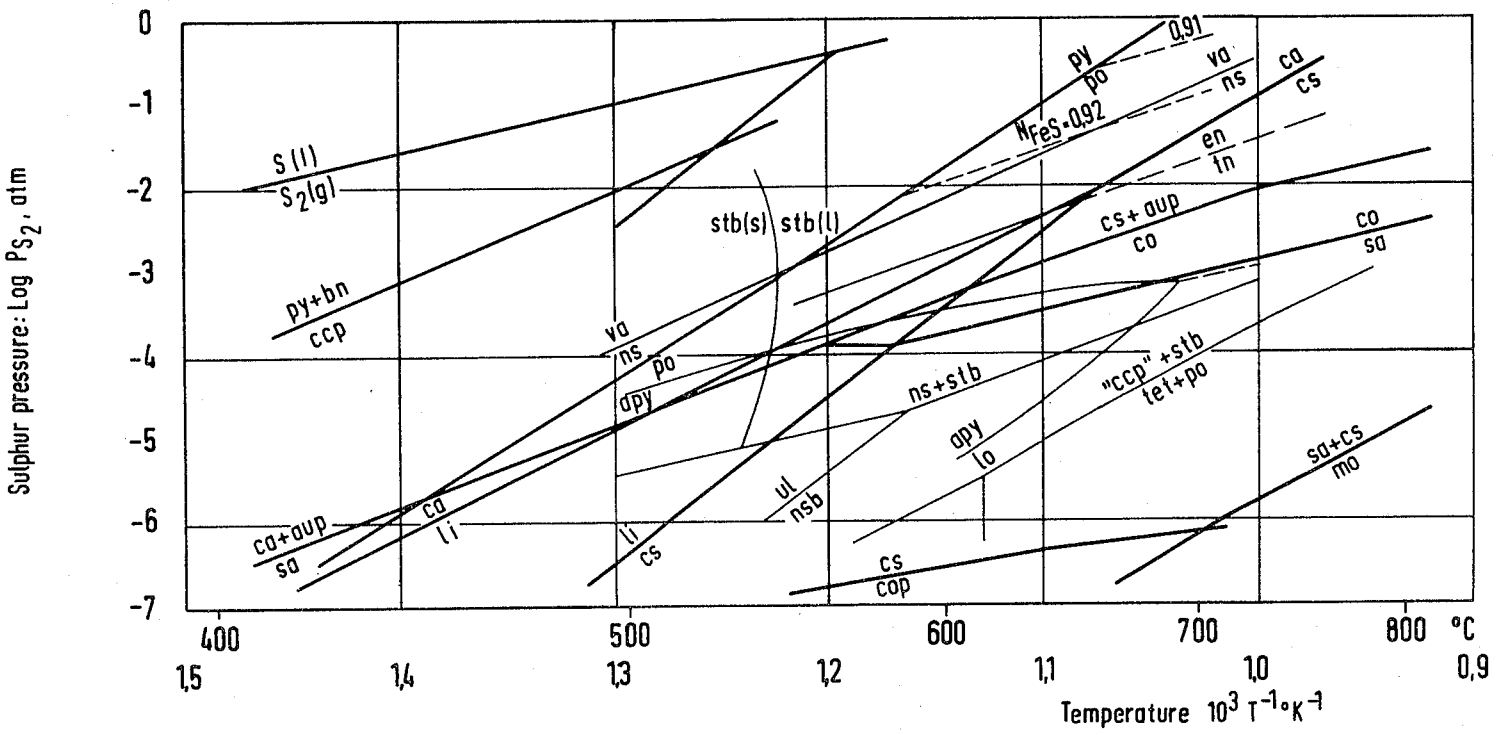
FIG. 1 depicts the stability ranges of the mineral structures concerned as a function of the sulfur pressure of the system and the temperature.

FIG. 1 shows the stability ranges of the above-mentioned mineral structures, calculated with the aid of known thermodynamic functions, as the function of the sulfur pressure of the system and the temperature. The figure also includes certain sulfide minerals of copper which contain arsenic and antimony.

The structural-change reactions of iron arsenide are taken as an example of the sulfidization:

$$2FeAs(s)+\tfrac{1}{2}S_2(g)\rightleftarrows FeS(s)+FeAs_2(s)$$

$$FeS(s)+FeAs_2(s)+\tfrac{1}{2}S_2(g)\rightleftarrows 2FeAsS(s)$$

$$2FeAsS(s)+S_2(2S_2)(g)\rightleftarrows 2FeS(2FeS_2)(s)+As_2S_2(l,g)$$

$$2FeAsS(s)+1\tfrac{1}{2}S_2(2\tfrac{1}{2}S_2)(g)\rightleftarrows 2FeS(2FeS_2)(s)+As_2S_3(l,g)$$

When gold and silver ores are treated, it is advantageous, in addition to the evaporation and/or sulfidization of the detrimental constituents (As, Sb, Bi, Se, Te), to obtain for the final product a certain structure as regards iron sulfides. In an alkalic cyanide solution, pyrite is less reactive than pyrrhotite, and therefore it is advantageous to obtain either pyrite or pyrite-surfaced pyrrhotite for the structure of the product.

The PTN equations corresponding to the pyrite/-pyrrhotite equilibrium (FIG. 1) are approximately as follows [D. J. Vaughan, J. R. Craig: Mineral chemistry of metal sulfides, Cambridge 1978, 285, 286]:

$$N = N_{FeS} = mol\ FeS/(mol\ FeS + mol\ S2)$$

$$N_{FeS} = 0.905\text{-}0.920\ (FeS_{1.210} - FeS_{1.174})$$

Phase boundary:

$$\text{Log}\ (P_{S2}/\text{atm}) = 17.235 - 16610\ T^{-1}$$

NPT equilibrium:

$$\text{Log}\ (P_{S2}/\text{atm}) = [-85.83\ N + 70.30][1000\ T^{-1} - 1] - 66.53\ N + 60.534$$

FeS activity:

$$\text{Log}\ a_{FeS} = [7.730\ N - 7.403][1000\ T^{-1} - 1] + 6.20\ N - 6.008$$

The equilibrium pressure corresponding to a pyrrhotite composition of, for example, $N_{FeS}=0.910$ ($FeS_{1.198}$, S=40.748% by weight) is $$\text{Log}\ P_{S2} = -7.805\ (1000\ T^{-1} - 1) - 0.008,$$

and the sulfur pressure value obtained from this at a temperature of 1000 K. is $P_{S2}=9.82\times10^{-1}$ atm.

The pyrite/pyrrhotite phase boundary corresponding to the pyrrhotite composition under discussion is reached at a temperature of T=933 K. The sulfur pressure of the system is in this case $P_{S2}=2.69\times10^{-1}$ atm and its iron sulfide activity (troilite) is $a_{FeS}=0.405$.

In addition to the elimination of the detrimental constituents and the control of the structure of the product matrix, the process under discussion controls the physical distribution of the gold and silver in the product phases so as to be advantageous for cyanidation.

As a result of numerous studies [U. A. Clark: Econ. Geol. 55, 1960, 1645] it can be shown at least qualitatively that at high temperatures gold is solid soluble in members of the mineral groups of the pyrite/marcasite family. When the temperature decreases, the gold separating from the solid solution is present in a sub-microscopic form in the matrix. By carrying out qualitative diffusion tests with both arsenopyrite and pyrite, it has been observed that gold is transferred not only by particle interface diffusion but in part also by space diffusion, which usually requires solid solubility.

Figure 2:
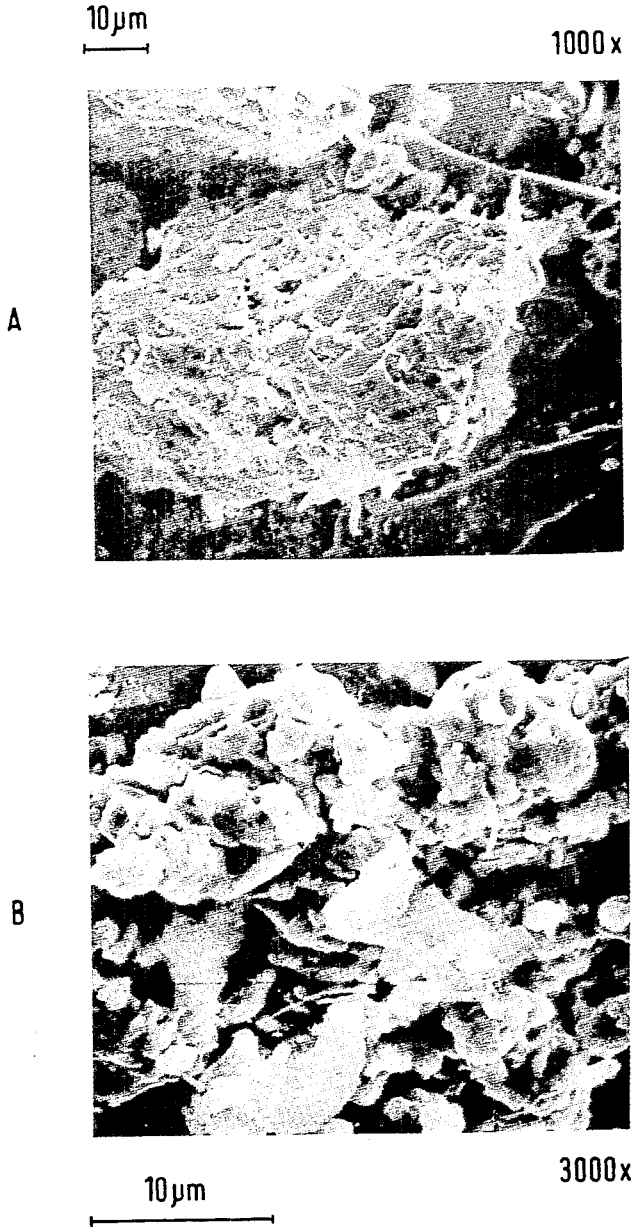
FIG. 2 depicts the particle structure of arsenopyrite before sulfidization (upper photograph, enlargement 1000×) and after sulfidization (lower photograph, enlargement 3000×)

In structural-change sulfidization there occurs, for example in the arsenopyrite/pyrite system, as arsenic sulfide leaves the system, extensive decrease in the primary particle size and pore formation. The free surface of the product mineral, as well as the number of particle interfaces is often decades higher than in the initial mineral. FIG. 2 shows the particle structure of arsenopyrite prior to (A) and after (B) sulfidization.

Owing to the breaking down and rearrangement of the gold-bearing mineral structure at the sulfidization temperature (600°-900° C.), the sub-microscopic gold is released. Part of this gold is transferred by particle interface diffusion and part is spread directly onto the free pore surfaces (surface diffusion). The redistribution of the originally native gold occurs at an elevated temperature at least in part by mediation of particle interfaces.

In the process under discussion, the transfer and distribution of gold onto the pore surfaces is strongly affected by the evaporation/condensation mechanism.

The convex or plane surface of the native of particle-interface gold has a higher vapor pressure than has a respective concave surface (pore surface). The pressure difference is determined by the Kelvin equation, i.e.

$$\ln(P_1/P_o) = [M\times\gamma/\rho\times R\times T]\cdot r^{-1},$$

where $P_1$ is the vapor pressure of the convex and $P_o$ that of a plane surface; M, $\gamma$ and $\rho$ are the molecular weight, surface energy and density of the substance; R is the gas constant ($8.314\times10^{-7}$ erg$\times$K$^{-1}\times$mol$^{-1}$), and r is the radius of curvature of the surface. This difference in potential causes the vaporization of gold from the plane or convex surface and its condensation on the concave pore surface.

The vapor pressure of gold is low. At the high sulfur pressure of the process there forms a gaseous sulfide according to the reaction $$Au(s) + \tfrac{1}{2}S_2(g) \rightleftarrows AuS_{(g)}$$

and this sulfide meadiates the transfer of the gold. The equilibrium constant of the reaction is $$\text{Log}\ [P_{AuS}/P_{S2}^{\frac{1}{2}}\cdot a_{Au}] = -8919.0T^{-1} - 1.2019\ \text{Log}\ T + 9.1934$$

Figure 3:
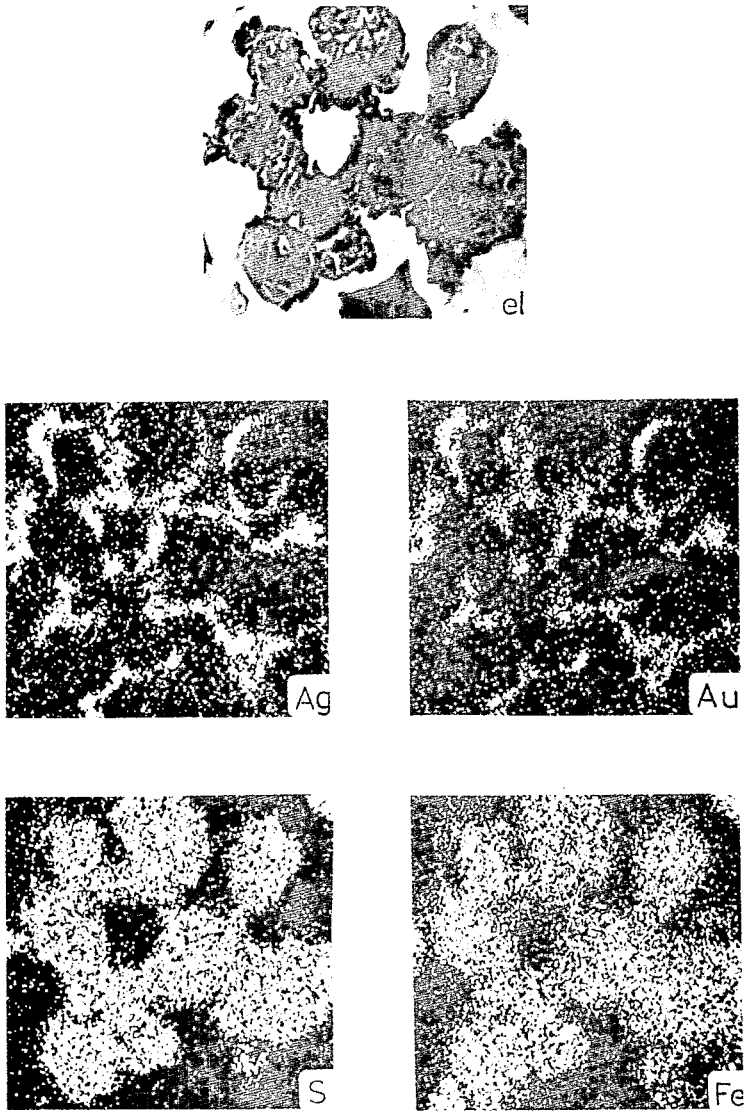
FIG. 3 depicts a microprobe sample of the mineral structure after sulfidization.

The vapor pressures obtained at temperatures of 1000 and 1200 K. at a sulfur pressure of half an atmosphere are $P_{AuS}=0.25$ and 6.17 mmHg, respectively. FIG. 3 shows the microprobe sample of the distribution of gold and silver on the iron sulfide surface formed during the sulfidization of arsenopyrite. The rapid transfer of both the gold and the silver onto the pore surfaces is a result of the joint action of particle-interface and surface diffusion and of the evaporation/condensation mechanism. It is evident that an increased sulfidization time has a favorable effect on the change in the distribution of native gold, especially if the particle size distribution of the gold is coarse.

Effect of sulfidization on the cyanidation of gold and silver

Considerable advantages are gained by controlled structural-change sulfidization when carrying out alkalic cyanidation of gold- and silver-bearing concentrates. Some of these advantages are:

The readily soluble sulfates, carbonates, hydroxides, hydroxycarbonates and oxides of iron, cobalt, nickel, manganese, copper and zinc sulfidize and become for the major part inert to leaching.

By controlling the sulfidization, very poorly soluble sulfides ($FeS_2$, $CuFeS_2$, etc.) are obtained in the alkalic solutions in one or two process stages.

The complex structures formed by the constituents (As, Sb, Bi, Se, Te, etc.) which inhibit cyanidation break down during the sulfidization, and the sulfides of the said elements evaporate or become inert.

Complex minerals which contain gold and silver break down when metals and sulfides are formed.

The organic compounds, frothing agents, carbon, etc., detrimental to cyanidation, are removed from the structures.

By controlled sulfidization, a distribution of gold (partly also of silver) along the pore surfaces, which is very advantageous for cyanidation, is achieved.

The structural-change sulfidization causes a sharp decrease in the primary particle size of the concentrates, a sharp increase in the particle interfaces and in the free surface area of the system, and consequently, enclosed gold is exposed and the thickness of the gold cover on the pore surfaces is decreased.

The decrease in surface area caused by the sulfidization also causes the release of the native gold, and, if the particle size of this gold is coarse, it is advisable to carry out, after the sulfidization, a gold separation based on the difference in specific gravities. It should also be noted that the increase in the internal surface area of the mineral causes an increase in the gross rate of surface reactions, and therefore additional sulfidization, surface oxidation and oxidation in an alkalic solution are easy to carry out (oxidation is advantageous for the passivation of the sulfide surface, for the removal of surface coverings from the gold, etc.).

Sulfidization eliminates the need for roasting gold- and silver-bearing concentrates which contain detrimental elements (As, Sb, Bi). The losses of valuable metals due to roasting are simultaneously eliminated. The presence of toxic compounds (oxides of As, Sb, Bi, etc.) which are created during roasting and which cause environmental problems and are difficult to store, is eliminated.

EXAMPLE

In the process embodiment according to the example, a structural-change sulfidization of a gold- and silver-bearing arsenopyrite/pyrite/pyrrhotite concentrate is carried out in order to remove the elements As, Sb, Bi, Se, Te from the concentrate and in order to distribute the gold and silver evenly onto the pore surface produced. The structural-change sulfidization is carried out advantageously within the pyrrhotite range of the PT field of the system. For the cyanide leach, the soluble pyrrhotite is brought to a poorly soluble form by forming around the pyrrhotite structure a pyrite structure layer by heat treating the sulfidized product within the pyrite range of the PT field. After the sulfidization, the gold and silver of the concentrate are leached by conventional cyanidation techniques.

The material and heat balances corresponding to the experiments of the example are compiled in Tables 1 and 2. The mineral analysis (% by weight) of the feed concentrate as regards the primary constituents was as follows: 44.28 Fe(As, Sb, Bi)S, 35.29 $FeS_2$, 10.41 $Fe_{12}S_{13}$, and 0.49 $CuFeS_2$. Table 1 shows the analysis of the constituents of the concentrate. The balances of the tables have been calculated on the basis of the extreme-end members, pyrrhotite (I) and pyrite (II), of the product phases of the processing range. In the sulfidization process corresponding to the example, the operation takes place within the pyrrhotite range, but after the basic sulfidization the temperature of the system is lowered in order to grow a thin pyrite layer on the surface of the pyrrhotite. When the operation takes place within the pyrite range (II), the process is strongly exothermal (Table 2). Within the pyrrhotite range, part of the sulfur of the feed must be burned in order to realize the heat balance (Table 1). In terms of heat technology, the process of the example lies between the extreme ends of the process range.

In the embodiment according to Balance I, the partial pressure of the sulfur vapor fed into the furnace is $P_{S2}=0.80$ atm. Part of the sulfur vapor is burned with oxygen-enriched (50% by weight O) air. The sulfides of the product gas phase (T=1000 K.), with the exception of bismuth sulfide, are calculated as dimers (sulfide total 0.6851 km), in which case the partial pressure of sulfur obtained for the gas phase is $P_{S2}=0.35$ atm. The pyrrhotite composition obtained in this case from the equations is $FeS_{1.18}$. The product sulfide together with the gas phase is cooled at the outlet end of the sulfidization furnace to a temperature of 939 K., whereby the pyrite-pyrrhotite phase boundary is reached (composition of pyrrhotite in sulfide equilibrium: $FeS_{1.20}$).

The amount of pyrite-surfaced product concentrate per one tonne of feed concentrate is 738.6 kg. The total enthalpy of the product constituents is (between the values of Tables 1 and 2) $\Delta H_{e+f}=236.684\times10^{-3}T+11.292\times10^{-6}T^2+1.308\times10^3T^{-1}-294.880$ Mcal.

The thermal losses from the system being constant (50 Mcal$\times$tn$^{-1}\times$h$^{-1}$), the value obtained for the cooling time (1000 K.$\rightarrow$940 K.) from the difference in level ($\Delta=38$ Mcal) is t=0.76 h.

The amount of heat released during the additional sulfidization process thus covers the losses of heat. According to practice, the said time is greater than necessary, and so is also the heat amount released, and so the outlet end of the furnace must be cooled. It should be noted that the effective particle size decreases sharply during structural-change sulfidization, and consequently the sulfidization and other reactions (e.g. surface oxidation) are very rapid.

It should be noted in particular that in the process embodiment corresponding to the example, the use of the pyrite/pyrrhotite equilibrium makes extensive control of the sulfidization process possible; this control is dependent on the concentrate type being processed, on the primary distribution of the noble metals in the concentrates, on the covering layer produced on the noble metals during the sulfidization, etc.

It should be pointed out that in the embodiment corresponding to the example, the gold present in the concentrate was mostly sub-microscopic, and therefore a lengthened sulfidization time required by large native gold particles was not necessary.

The cyanidation conditions of the sulfidized concentrate were as follows: density of suspension $\rho=10\%$, concentration of cyanide in the solution and acidity [NaCN]=0.3% and pH (CaO)=11.5, temperature T=293 K., leaching time t=8 h.

The highest leaching yields of several series of leaches were 96% for gold and 48% for silver. When short leaching times were used, there was scatter in the yield values; for example the following groups of values for gold were obtained (yield, %/time, h): 50-81/2, 51/90/4, 77-91/6 and 89-96/8. In the series of experiments, the yield of silver was lower than the yield of gold, which was mainly due to the short leaching time used. It can also be noted that the structural-change sulfidization did not always notably improve the yield of silver, especially when using high amounts of sulfur in the product. The addition of lead acetate (0.04% by weight) did not notably affect the solution yields in the case according to the example.

TABLE I

Example (I). Structural-change balances

Feed: 1000.000 concentrate + 279.110 sulfur + 30.481 nitrogen + 100.852 air (50% by weight) = 1410.443 kg Product: 715.958 concentrate + 336.085 evaporation + 176.540 sulfur + 30.481 nitrogen + 159.379 combustion gas = 1410.443 kg Analyses: Au and Ag, ppm; others, % by weight

| Constituent | A | Fe | Cu | Zn | Pb | Mn | Ni | Co | Au | Ag |
|---|---|---|---|---|---|---|---|---|---|---|
| | B | S | As | Sb | Bi | Se | Te | $SiO_2$ | $Al_2O_3$ | $MeO_x$ |
| Concentrate (S) | A | 38.20 | 0.17 | 0.20 | 0.05 | 0.05 | 0.02 | 0.03 | 88.20 | 31.00 |
| | B | 31.90 | 20.30 | 0.08 | 0.02 | 0.06 | 0.05 | 5.60 | 1.80 | 0.68 |
| Concentrate (T) | A | 53.36 | 0.24 | 0.28 | 0.07 | 0.07 | 0.03 | 0.04 | 123.19 | 43.30 |
| | B | 33.52 | — | — | — | — | — | 7.82 | 2.51 | 0.95 |
| Evaporation | A | — | — | — | — | — | — | — | — | — |
| | B | 38.99 | 60.40 | 0.24 | 0.05 | 0.18 | 0.15 | — | — | — |

Me = Ca, Mg, Ti, Zr, Cr

Example (I). Heat balance

Losses of heat from the sulfidization furnace are 50 Mcal per one tonne of feed concentrate.
Feed temperatures are indicated as follows: $T_1$/concentrate, $T_2$/sulfur + nitrogen, $T_3$/air
Product temperatures are indicated as follows: $T_4$/concentrate, $T_5$/evaporation, $T_6$/sulfur + nitrogen, $T_7$/combustion gases Feed: $\Delta H_{e+f}$, Mcal $= 131.878 \times 10^{-3} T_1 + 17.364 \times 10^{-6} T_1^2 + 1.886 \times 10^3 T_1^{-1} + 46.421 \times 10^{-3} T_2 + 25.328 \times 10^{-3} T_3 - 156.784$ Product: $\Delta H_{e+f}$, Mcal $= 109.980 \times 10^{-3} T_4 + 8.978 \times 10^{-6} T_4^2 + 1.076 \times 10^3 T_4^{-1} + 57.839 \times 10^{-3} T_5 + 2.730 \times 10^{-6} T_5^2 + 32.394 \times 10^{-3} T_6 + 33.497 \times 10^{-3} T_7 - 219.302$ Balance is realized by substituting the following temperatures: $T_1 = 750$ K., $T_2$-$T_7 = 1000$ K.
Balance total is $\Delta H_{e+f} = 27.193$ Mcal
Composition of the combustion gases is as follows (% by weight): 66.69 $SO_2$ + 33.31 $N_2$ + Ar, etc.

TABLE II

Example (II). Structural-change balance

Feed: 1000.000 concentrate + 429.112 sulfur + 46.862 nitrogen = 1475.974 kg

Product: 916.487 concentrate + 336.085 evaporation + 176.540 sulfur + 46.862 nitrogen = 1475.974 kg Analyses: Au and Ag, ppm; others, % by weight

| Constituent | A | Fe | Cu | Zn | Pb | Mn | Ni | Cu | Au | Ag |
|---|---|---|---|---|---|---|---|---|---|---|
| | B | S | As | Sb | Bi | Se | Te | $SiO_2$ | $Al_2O_3$ | $MeO_x$ |
| Concentrate (S) | A | 38.20 | 0.17 | 0.20 | 0.05 | 0.05 | 0.02 | 0.03 | 88.20 | 31.00 |
| | B | 31.90 | 20.30 | 0.08 | 0.02 | 0.06 | 0.05 | 5.60 | 1.80 | 0.68 |
| Concentrate (T) | A | 41.68 | 0.19 | 0.22 | 0.06 | 0.06 | 0.02 | 0.03 | 96.24 | 33.83 |
| | B | 48.07 | — | — | — | — | — | 6.11 | 1.96 | 0.74 |
| Evaporation | A | — | — | — | — | — | — | — | — | — |
| | B | 38.99 | 60.40 | 0.24 | 0.05 | 0.18 | 0.15 | — | — | — |

Me = Ca, Mg, Ti, Zr, Cr

Example (II). Heat balance

Losses of heat from the sulfidization furnace are 50 Mcal per one tonne of feed concentrate
Feed and product temperatures are indicated as in Table I.

Feed: $\Delta H_{e+f}$, Mcal $= 131.878 \times 10^{-3} T_1 + 17.364 \times 10^{-6} T_1^2 + 1.886 \times 10^3 T_1^{-1} + 71.370 \times 10^{-3} T_2 - 84.185$ Product: $\Delta H_{e+f}$, Mcal $= 146.116 \times 10^{-3} T_4 + 5.178 \times 10^{-6} T_4^2 + 3.151 \times 10^3 T_4^{-1} + 57.839 \times 10^{-3} T_5 + 2.730 \times 10^{-6} T_5^2 + 36.829 \times 10^{-3} T_6 - 237.039$ Heat balance is realized by substituting the following temperatures:
$T_1 = 300$ K., $T_2 = 723$ K., $T_4$-$T_6 = 1000$ K.

What is claimed is:

1. A process for the separation of gold and silver from complex sulfide ores and concentrates which, in addition to the primary metals, contain constituents detrimental to the separation of noble metals, comprising heating the sulfide ore or concentrate at a temperature of 600°-900° C. and at a sulfur pressure of 0.2-1 atm in order to bring the complex metal compounds into a form suitable for subsequent alkalic cyanide leaching; alkali cyanide leaching the heat-treated ore or concentrate to produce a gold- and silver-bearing cyanide solution and an undissolved residue; and separating the gold- and silver-bearing cyanide solution from the undissolved residue, and including cooling the hot sulfide ore or concentrate within the stability range of pyrite so that a pyrite coating is formed on the particles.

* * * * *

UNITED STATES PATENT AND TRADEMARK OFFICE

CERTIFICATE OF CORRECTION

PATENT NO. : 4,431,614

DATED : February 14, 1984

INVENTOR(S) : SIMO A. I. MAKIPIRTTI et al

It is certified that error appears in the above-identified patent and that said Letters Patent are hereby corrected as shown below:

Column 4, lines 39-40:

"...(Cu, Ag, Fe, Ge, Hg, Sn)$_{1-2}$..." should read --...(Co, Ag, Fe, Ge, Hg, Sn)$_{12}$--

Column 7, line 44:

"thioarsensite" should read --thioarsenite--

Signed and Sealed this

Fifth Day of February 1985

[SEAL]

*Attest:*

DONALD J. QUIGG

*Attesting Officer* *Acting Commissioner of Patents and Trademarks*